United States Patent [19]

Greer

[11] 4,363,267

[45] Dec. 14, 1982

[54] VERTICAL BALER WITH IMPROVED SAFETY GATE AND DOOR LATCH SYSTEM

[75] Inventor: Charles H. Greer, Piqua, Ohio

[73] Assignee: Piqua Engineering, Inc., Piqua, Ohio

[21] Appl. No.: 220,900

[22] Filed: Dec. 29, 1980

[51] Int. Cl.[3] ..... B30B 15/00

[52] U.S. Cl. ..... 100/255; 16/198; 49/445; 74/616; 292/113

[58] Field of Search ..... 100/53, 255, 292; 16/198; 74/612, 616; 292/113, 285; 49/445, 200

[56] References Cited

U.S. PATENT DOCUMENTS

| | | | |
|---|---|---|---|
| 184,539 | 11/1876 | Miller | 100/255 X |
| 2,966,706 | 1/1961 | Christensen | 292/113 X |
| 3,095,922 | 7/1963 | Frazier | 16/198 X |
| 3,851,577 | 7/1974 | Newcom et al. | 100/255 X |
| 3,916,781 | 4/1975 | Cerniglia | 100/255 X |
| 4,182,236 | 5/1980 | Greer | 100/255 X |
| 4,232,599 | 11/1980 | Ulrich | 100/53 X |

*Primary Examiner*—Billy J. Wilhite

*Attorney, Agent, or Firm*—Jacox & Meckstroth

[57] ABSTRACT

A vertical baler includes a housing defining a compacting chamber which receives a vertically moveable and power operated horizontal platen. The chamber has a front opening, and the lower portion of the chamber is closed by a pivotal door member which is secured to the cabinet by a latch mechanism including two separate pivotal members releasably connected by an overcenter lock element. The upper part of the opening is closed by a vertical safety gate member which retracts upwardly and is partially counterbalanced by a torsion coil spring having one end portion secured to the housing. The other end portion of the coil spring is connected to a shaft supporting a pair of winch members around which are wrapped corresponding cables connected to the lower portion of the gate member.

7 Claims, 7 Drawing Figures

VERTICAL BALER WITH IMPROVED SAFETY GATE AND DOOR LATCH SYSTEM

BACKGROUND OF THE INVENTION

In a vertical baler for scrap material, for example, of the type disclosed in U.S. Pat. Nos. 3,851,577 and 4,182,236 which are assigned to the assignee of the present invention, a vertical cabinet or baler housing defines a generally rectangular compacting chamber in which a horizontal platen is moved vertically by a hydraulic cylinder between an upper retracted position and a lower compacting position for compressing the material within the chamber into a bale. The compacting chamber has a front opening, and the lower portion of the opening is closed either by a pair of pivotally supported door members as shown in the above patents or by a single pivotally supported door member, for example, as disclosed in U.S. Pat. No. 3,916,781. The upper portion of the front opening is preferably closed by a vertical gate member which is supported for sliding vertical movement between a lower close position and a retracted upper or open position so that batches of scrap material may be successively added to the compacting chamber.

As disclosed in above mentioned U.S. Pat. No. 3,916,781, the lower pivotal door member is latched in its closed position by a locking angle which is pivotally supported by the cabinet or housing. After the door member is closed, the latching angle is manually pivoted to a latched position where the locking angle is secured by a hook-like dog or latch element pivotally supported by the door member. It is apparent that after scrap material has been compacted into a bale within the compacting chamber, the material exerts a substantial pressure against the door member. It has therefore been found desirable to provide for partially releasing the door latch so that the door member may be slightly opened and the pressure on the door member may be released before the latch member is completely released.

As disclosed in above mentioned U.S. Pat. No. 3,851,577, the vertical safety gate is moved to its upper retracted position when the ram or platen is retracted upwardly, and the safety gate is lowered to its closed position in response to the initial downward movement of the platen. It has been found sometimes desirable to provide for manually moving the safety gate downwardly to its closed position prior to moving the platen downwardly for compacting material within the chamber. When such manual operation of the safety gate is desired, the weight of the safety gate is counterbalanced by the addition of weight members which are usually located adjacent the sides of the baler housing and are connected to opposite ends of the safety gate by cables which extend over corresponding pulleys located above the safety gate.

SUMMARY OF THE INVENTION

The present invention is directed to a vertical compactor or baler of the type described above and which incorporates improved means for closing the front opening of the vertical compacting chamber. In general, the improvement means include a system for counterbalancing the weight of the safety gate which covers or closes the upper portion of the front opening and a conveniently operable latch mechanism for locking the pivotal door which closes the lower portion of the front opening. The improved counterbalancing system for the safety gate provides for quickly moving the safety gate between its open and closed positions and significantly reduces the shipping weight of the vertical baler in addition to providing for a more compact housing. The door latch mechanism of the invention provides for quickly and easily releasing the pressure exerted on the door by the material compacted within the chamber and before the door may be fully opened to remove the compacted material in the form of a bale.

Other features and advantages of the invention will be apparent from the following description, the accompanying drawings and the appended claims.

DESCRIPTION OF THE PREFERRED EMBODIMENTS

Figure 1:
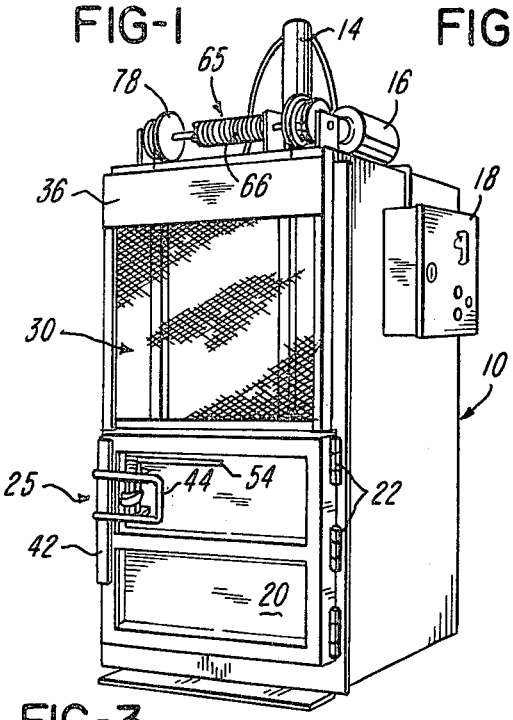
FIG. 1 is a perspective view of a vertical baler incorporating an improved closure system constructed in accordance with the invention.

The vertical baler illustrated in FIG. 1 includes a rectangular upright cabinet or housing 10 which is fabricated of steel, for example, in a manner as disclosed in above mentioned U.S. Pat. Nos. 3,851,577 and 4,182,236. The housing 10 defines a compacting chamber 12 (FIG. 5) in which a horizontal platen or ram is supported for vertical movement by the lower end portion of a piston projecting downwardly from a hydraulic cylinder 14 mounted on the upper or top wall of the housing. The cylinder 14 is actuated by a hydraulic pump-motor unit 16 which is also mounted on the top wall of the housing, and a portion of the top wall defines a hydraulic reservoir, as disclosed in above mentioned U.S. Pat. No. 3,851,577. The operation of the motor-pump unit 16 is controlled from a control box 18 mounted on one of the side walls of the housing 10.

Figure 6:
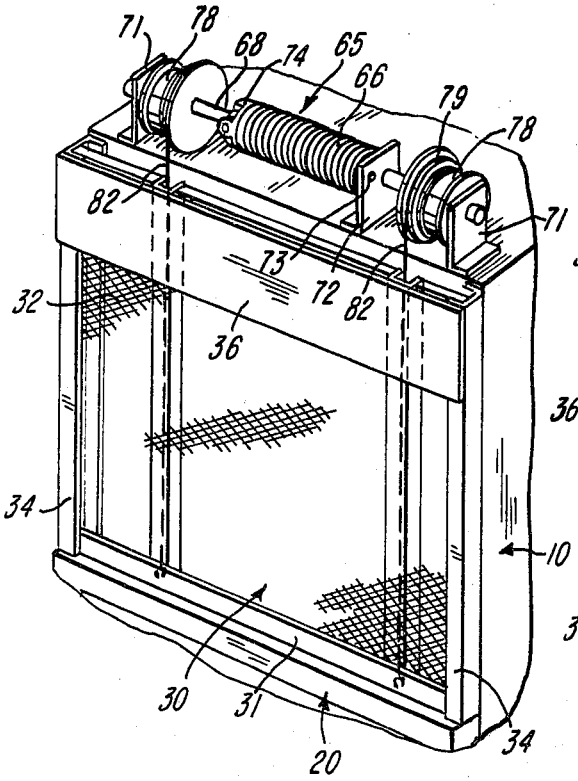
FIG. 6 is a enlarged perspective view of a portion of the baler shown in FIG. 1 and illustrating the counterbalancing system for the safety gate in its closed position.
Figure 7:
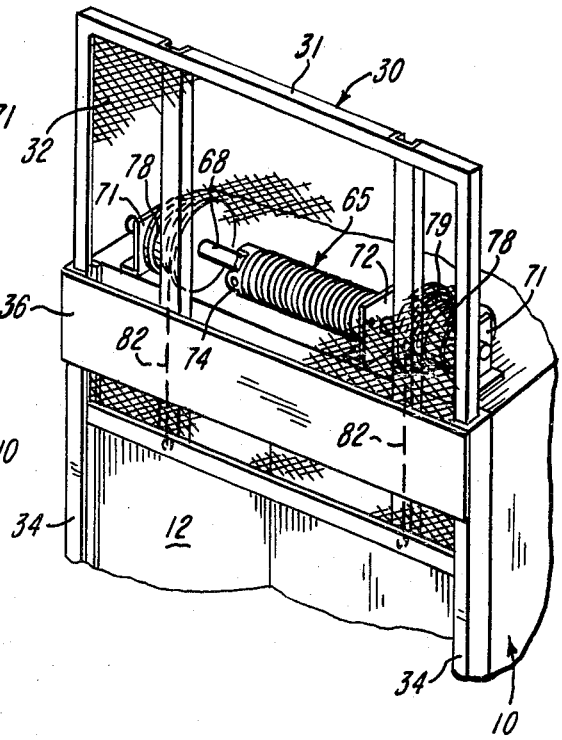
FIG. 7 is a view similar to FIG. 6 and illustrating the safety gate retracted to its open position.

As shown in FIG. 1, the compacting chamber 12 defined by the housing 10 has a rectangular front opening, and the lower portion of the opening is normally closed by a door or door member 20 pivotally supported by a set of hinges 22 mounted on the housing 10. The outer swinging end portion of the door member 20 is releasably coupled or secured to the housing 10 by a latch mechanism 25. The upper portion of the front opening is normally closed by a vertical safety gate 30 which is formed by a rectangular frame 31 (FIG. 7) supporting a woven wire mesh 32. As shown in FIGS. 6 and 7, the safety gate 30 is supported for vertical sliding movement by a pair of opposing channels 34 mounted on the side walls of the housing 10. The channels 34 are also connected by a steel header plate 36.

Figure 4:
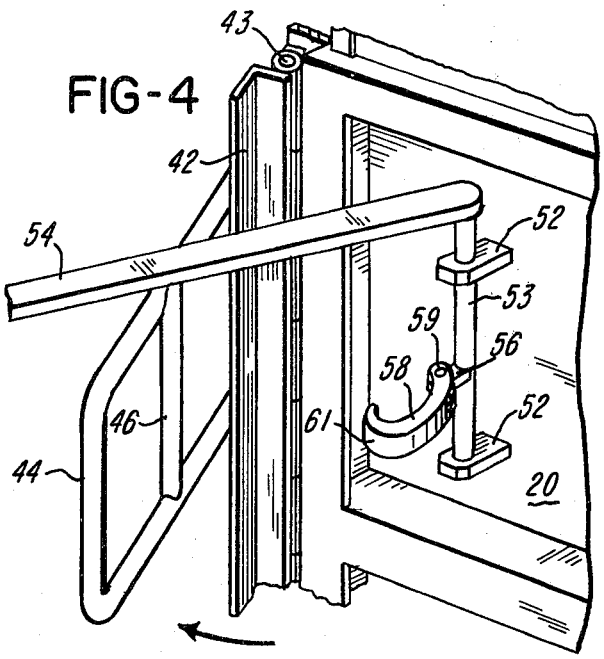
FIG. 4 is a view similar to FIG. 3 and illustrating the latch mechanism in its fully released position.
Figure 5:
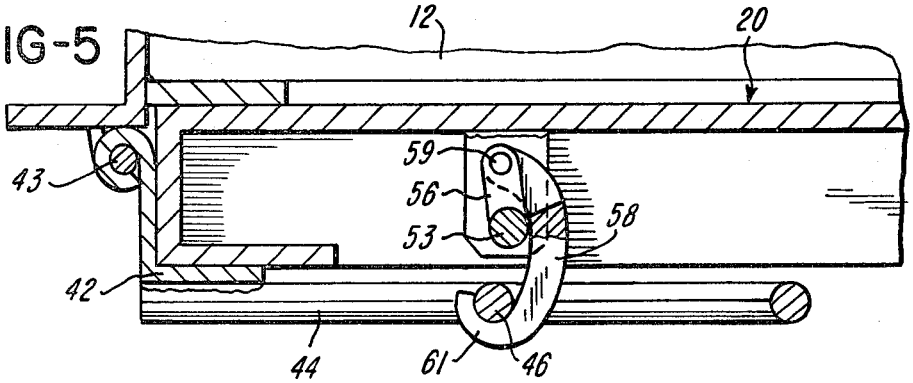
FIG. 5 is a fragmentary section of the latch mechanism in its locked position and taken generally on the line 5—5 of FIG. 2.

In accordance with the present invention, the latch mechanism 25 includes a right angle clamp member 42 (FIG. 2) which is pivotally connected to the adjacent side wall of the housing 10 by a hinge 43 (FIGS. 4 and 5). A U-shaped handle member 44 is secured or welded to the clamp member 42 and includes a vertical cross rod 46 which is welded to the legs of the handle member 44. The pivotal door 20 supports a pair of vertically spaced bearing blocks 52 (FIG. 4) which rotatably support a vertical shaft 53. A lever arm 54 is secured or welded to the upper end portion of the shaft 53, and the center portion of the shaft 53 carries an outwardly projecting plate or tab 56. An arcuate-shaped latch element or member 58 is pivotally supported by the tab 56 and a connecting pivot pin 59, and the latch element 58 has a hook-like outer end portion 61.

Figure 2:
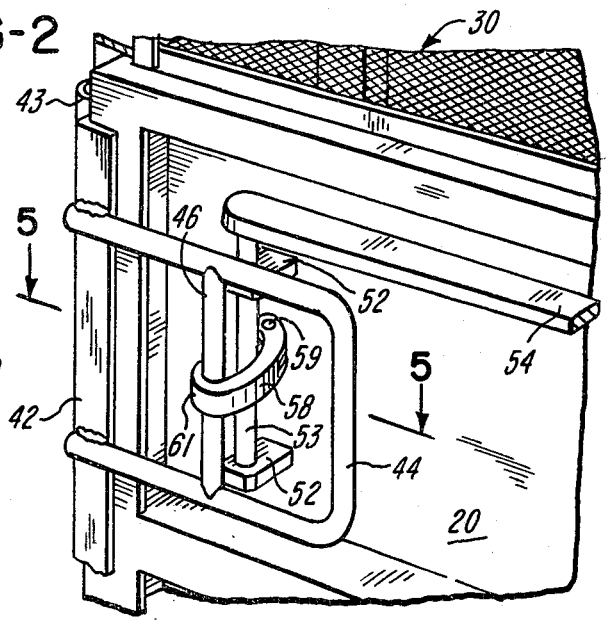
FIG. 2 is a fragmentary perspective view of the door latch mechanism shown in FIG. 1 and illustrating the mechanism in its locked position.

The latch mechanism 25 is illustrated in its latched or fully locked position in FIGS. 1, 2 and 5. In this position, the angle clamp member 42 projects over the edge portion of the door 20 (FIG. 5), and the latch element 58 is hooked to the cross rod 46 and positively retains the clamp member 42 and the handle 44 in the locked position as a result of the over-center movement of the pivot pin 59 through a plane defined by the axes of the rod 46 and shaft 53.

Figure 3:
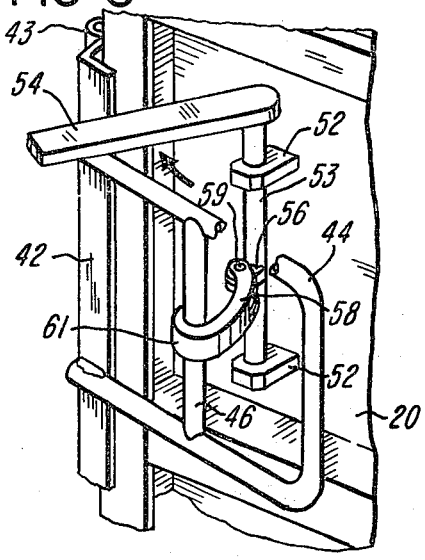
FIG. 3 is a fragmentary perspective view of the door latch mechanism and illustrating the mechanism in a partially released position.

After scrap material has been compacted into a bale within the chamber 12 and it is desired to open the door 20 for tying and removing the bale, the hand lever 54 is pivoted clockwise from its locked position (FIG. 2) to a door release position (FIG. 3) where the clamp member 42 and handle 44 are slightly pivoted and the door 20 is partially opened or cracked to release the pressure exerted on the inner surface of the door by the compacted material. When the lever 54 is rotated clockwise (FIG. 3), the pivot pin 59 (FIG. 5) passes over-center or through the plane defined by the axes of the rod 46 and shaft 53, but the latch element 58 remains hooked to the cross rod 46 of the handle member 44. After the latch mechanism 25 is partially released and the door 20 is partially opened by a slight angle, the latch element 58 is unhooked from the cross rod 46 so that the handle 44 and clamp member 42 may be pivoted clockwise (FIG. 4) to an open position where the clamp member 42 no longer blocks the opening of the door 20 to its fully opened position.

Referring to FIGS. 6 and 7, the weight of the safety gate 30 is carried by a counterbalancing system 65 which incorporates an elongated torsion coil spring 66. The spring 66 surrounds a horizontal shaft 68 which is rotatably supported by a set of axially spaced support brackets 71 and 72 mounted on the top wall of the housing 10. One end portion of the coil spring 66 is connected by a bolt 73 to the bracket 72, and the opposite end portion of the spring 66 is connected to a block 74 rigidly secured to the shaft 68. A pair of winch elements or drums 78 are also secured to the shaft 68, and each drum 78 has a compound helical-spiral groove 79.

A pair of flexible cables 82 have lower end portions secured to the bottom of the frame 31 of the safety gate 30. The upper end portions of the cables 82 are partially wrapped within the larger diameter of the corresponding grooves 79 and are secured to the corresponding drums 78. The torsion coil spring 66 is prewound so that it applys a torque to the shaft 68 whereby the upward force exerted by the cables 82 on the safety gate 30 is substantially equal to the weight of the safety gate. When the safety gate 30 is raised or elevated to its open position (FIG. 7), the cables 82 wrap onto the progressively reducing diameter of the grooves 79 while the coil spring 66 partially unwinds. The progressively reducing diameter of the grooves 79 automatically compensate for the progressively reducing torque applied by the unwinding coil spring 66 to the shaft 68. As a result, the upward lifting force exerted by the cables 82 on the safety gate 30 remains substantially constant so that the weight of the safety gate is substantially counterbalanced at all times while the safety gate is moved between its open and closed positions.

From the drawings and the above description, it is apparent that a vertical compactor or baler having a front opening closure system constructed in accordance with the invention, provides desirable features and advantages. For example, the construction and operation of the latch mechanism 25 enables the door 20 to be quickly moved from its fully closed position to a partially open or released position in order to release the substantial pressure exerted on the inner surface of the door by the compacted material. Thus the latch mechanism assures that the pressure on the door is first released before the latch element 58 may be uncoupled from the latch handle 44 after which the door may be fully opened. The over-center movement of the latch element 58 also assures that the latch mechanism is positively locked in the door closed position shown in FIG. 5 and also permits the latch mechanism to be quickly released for opening the door so that each bale of compacted material may be quickly tied and removed. The safety gate counterbalancing system described in connection with FIGS. 6 and 7 also provides desirable features and advantages. For example, the counterbalancing system requires no additional floor space for the baler and is located within a compact space directly above the front opening of the baler housing. The counterbalancing system also eliminates the need for shipping counterbalancing weights and operates to provide a substantially constant lifting force on the safety gate 30.

While the form of vertical compacting or baling apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In a baler adapted for compacting scrap material and including a vertical housing having opposite side walls connected by a rear wall and a top wall and defining a compacting chamber having a front opening, a door member supported for pivotal movement between an open position and a closed position covering a lower portion of said front opening, latch means for securing said door member in said closed position, a gate member supported for movement between a retracted position providing for adding successive batches of material over said door member and a closed position covering an upper portion of said front opening, a power operated generally horizontal platen movable vertically within said chamber between a retracted upper position and a lower position for compacting the material within said chamber into a bale, the improvement wherein said latch means comprise a first latch member including a handle portion, pivot means connecting said first latch member to said housing adjacent one of said side walls and providing for moving said first latch member between a released position for opening said door member and a clamped position where said first latch member clamps said door member to said housing, a lever actuated member supported by said door member for rotation on an axis extending substantially parallel to said door member, a second latch member connected to said lever actuated member for pivotal movement eccentric to said axis of rotation, and said second latch member being movable between an outer released position engagable with said first latch member and a retracted locked position locking said first latch member in said clamped position in response to rotation of said lever actuated member.

2. A baler as defined in claim 1 wherein said second latch member passes through an over-center condition while moving between said released and locked positions.

3. A baler as defined in claim 2 wherein said first latch member comprises an angled door clamp member, said handle portion secured to said clamp member and projecting therefrom, and means on said handle portion for receiving said second latch member in said released position.

4. A baler as defined in claim 1 wherein said second latch member is arcuate in configuration and includes a hook-like portion for engaging said first latch member, said lever actuated member includes a vertical shaft supporting an outwardly projecting tab, means mounted on said door member and rotatably supporting said shaft, and a pin pivotally connecting said tab to said second latch member.

5. A baler as defined in claim 4 wherein said second latch member passes through an over-center condition while moving between said released and locked positions.

6. In a baler adapted for compacting scrap material and including a vertical housing having opposite side walls connected by a rear wall and a top wall and defining a compacting chamber having a front opening, a door member supported by one of said side walls for pivotal movement between an open position and a closed position covering a lower portion of said front opening, latch means for securing said door member in said closed position, a rigid vertical gate member supported for movement along a vertical path between an upper retracted position providing for adding successive batches of material over said door member and a lower closed position covering the upper portion of said front opening, a power operated generally horizontal platen movable vertically within said chamber between a retracted upper position and a lower position for compacting the material within said chamber in a bale, the improvement comprising an elongated shaft extending across said top wall of said housing and being positioned in back of said vertical path of said gate member, a set of spaced support brackets secured to said top wall and supporting said shaft for rotation, an elongated torsion coil spring surrounding said shaft and having opposite end portions, a spring support member mounted on said top wall of said housing and connected to one of said end portions of said coil spring, means connecting the other said end portion of said coil spring to said shaft, a set of drum members mounted on said shaft, a corresponding set of elongated flexible members extending around said drum members and having vertical portions extending downwardly between said top wall and said vertical path of said gate member and connected to said gate member, and said coil spring being prewound to apply a torque to said shaft and said drum members for at least partially counterbalancing the weight of said gate member to facilitate moving said gate member vertically between said retracted and closed positions.

7. A baler as defined in claim 6 wherein said gate member includes horizontally spaced vertical support members for receiving said vertical portions of said flexible members.

* * * * *